US007250011B2

(12) United States Patent
Simonds et al.

(10) Patent No.: US 7,250,011 B2
(45) Date of Patent: Jul. 31, 2007

(54) AERODYNAMIC PATTERN FOR A GOLF BALL

(75) Inventors: Vincent J. Simonds, Brimfield, MA (US); Thomas F. Bergin, Holyoke, MA (US); Thomas A. Veilleux, Charlton, MA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 11/276,786

(22) Filed: Mar. 14, 2006

(65) Prior Publication Data

US 2006/0229142 A1 Oct. 12, 2006

Related U.S. Application Data

(60) Provisional application No. 60/594,190, filed on Mar. 17, 2005.

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS

| | | | | |
|---|---|---|---|---|
| 2,002,726 | A | | 5/1935 | Young |
| 4,266,773 | A | | 5/1981 | Treadwell |
| 4,722,529 | A | | 2/1988 | Shaw et al. |
| 4,787,638 | A | | 11/1988 | Kobayashi |
| 4,830,378 | A | | 5/1989 | Aoyama |
| 4,836,552 | A | | 6/1989 | Puckett et al. |
| 5,143,377 | A | * | 9/1992 | Oka et al. ..... 473/383 |
| 5,338,039 | A | * | 8/1994 | Oka et al. ..... 473/384 |
| 5,356,150 | A | | 10/1994 | Lavallee et al. |
| 5,377,989 | A | | 1/1995 | Machin |
| 5,470,076 | A | | 11/1995 | Cadorniga |
| 5,536,013 | A | | 7/1996 | Pocklington |
| 5,722,903 | A | | 3/1998 | Shaw et al. |
| D406,623 | S | | 3/1999 | Steifel |
| 5,885,172 | A | * | 3/1999 | Hebert et al. ..... 473/354 |
| 5,890,975 | A | | 4/1999 | Steifel |
| 5,916,044 | A | | 6/1999 | Shimosaka et al. |
| 6,290,615 | B1 | | 9/2001 | Ogg |
| 7,144,338 | B2 | * | 12/2006 | Sullivan et al. ..... 473/383 |
| 2003/0190979 | A1 | * | 10/2003 | Sajima ..... 473/383 |
| 2004/0127306 | A1 | * | 7/2004 | Sato et al. ..... 473/383 |

* cited by examiner

*Primary Examiner*—Raeann Trimiew
(74) *Attorney, Agent, or Firm*—Michael A. Catania; Elaine H. Lo

(57) ABSTRACT

A golf ball having traditional dimples and a tubular lattice structure is disclosed herein. The golf ball has dimples and a plurality of lattice members that form multi-faceted polygons. Each of the plurality of lattice members has an apex and the golf ball of the present invention conforms with the 1.68 inches requirement for USGA-approved golf balls. The interconnected lattice members form a plurality of polygons, preferably hexagons and pentagons. Each of the lattice members preferably has a continuous contour.

15 Claims, 10 Drawing Sheets

AERODYNAMIC PATTERN FOR A GOLF BALL

CROSS REFERENCES TO RELATED APPLICATIONS

The Present Application claims priority to U.S. Provisional Patent Application No. 60/594,190, which was filed on Mar. 17, 2005.

STATEMENT REGARDING FEDERALLY SPONSORED RESEARCH OR DEVELOPMENT

Not Applicable

BACKGROUND OF THE INVENTION

1. Field of the Invention

The present invention relates to an aerodynamic surface geometry for a golf ball. More specifically, the present invention relates to an aerodynamic pattern for a golf ball comprising a plurality of dimples and multi-faceted polygons.

2. Description of the Related Art

Golfers realized perhaps as early as the 1800's that golf balls with indented surfaces flew better than those with smooth surfaces. Hand-hammered gutta-percha golf balls could be purchased at least by the 1860's, and golf balls with brambles (bumps rather than dents) were in style from the late 1800's to 1908. In 1908, an Englishman, William Taylor, received a British patent for a golf ball with indentations (dimples) that flew better and more accurately than golf balls with brambles. A.G. Spalding & Bros., purchased the U.S. rights to the patent (embodied possibly in U.S. Pat. No. 1,286,834 issued in 1918) and introduced the GLORY ball featuring the TAYLOR dimples. Until the 1970s, the GLORY ball, and most other golf balls with dimples had 336 dimples of the same size using the same pattern, the ATTI pattern. The ATTI pattern was an octahedron pattern, split into eight concentric straight line rows, which was named after the main producer of molds for golf balls.

The only innovation related to the surface of a golf ball during this sixty year period came from Albert Penfold who invented a mesh-pattern golf ball for Dunlop. This pattern was invented in 1912 and was accepted until the 1930's. A combination of a mesh pattern and dimples is disclosed in Young, U.S. Pat. No. 2,002,726, for a Golf Ball, which issued in 1935.

The traditional golf ball, as readily accepted by the consuming public, is spherical with a plurality of dimples, with each dimple having a circular cross-section. Many golf balls have been disclosed that break with this tradition, however, for the most part these non-traditional golf balls have been commercially unsuccessful.

Most of these non-traditional golf balls still attempt to adhere to the Rules Of Golf as set forth by the United States Golf Association ("USGA") and The Royal and Ancient Golf Club of Saint Andrews ("R&A"). As set forth in Appendix III of the Rules of Golf, the weight of the ball shall not be greater than 1.620 ounces avoirdupois (45.93 gm), the diameter of the ball shall be not less than 1.680 inches (42.67 mm) which is satisfied if, under its own weight, a ball falls through a 1.680 inches diameter ring gauge in fewer than 25 out of 100 randomly selected positions, the test being carried out at a temperature of 23±1° C., and the ball must not be designed, manufactured or intentionally modified to have properties which differ from those of a spherically symmetrical ball.

One example is Shimosaka et al., U.S. Pat. No. 5,916,044, for a Golf Ball that discloses the use of protrusions to meet the 1.68 inch (42.67 mm) diameter limitation of the USGA and R&A. The Shimosaka patent discloses a golf ball with a plurality of dimples on the surface and a few rows of protrusions that have a height of 0.001 to 1.0 mm from the surface. Thus, the diameter of the land area is less than 42.67 mm.

Another example of a non-traditional golf ball is Puckett et al., U.S. Pat. No. 4,836,552 for a Short Distance Golf Ball, which discloses a golf ball having brambles instead of dimples in order to reduce the flight distance to half of that of a traditional golf ball in order to play on short distance courses.

Another example of a non-traditional golf ball is Pocklington, U.S. Pat. No. 5,536,013 for a Golf Ball, which discloses a golf ball having raised portions within each dimple, and also discloses dimples of varying geometric shapes, such as squares, diamonds and pentagons. The raised portions in each of the dimples of Pocklington assist in controlling the overall volume of the dimples.

Another example is Kobayashi, U.S. Pat. No. 4,787,638 for a Golf Ball, which discloses a golf ball having dimples with indentations within each of the dimples. The indentations in the dimples of Kobayashi are to reduce the air pressure drag at low speeds in order to increase the distance.

Yet another example is Treadwell, U.S. Pat. No. 4,266,773 for a Golf Ball, which discloses a golf ball having rough bands and smooth bands on its surface in order to trip the boundary layer of air flow during flight of the golf ball.

Aoyama, U.S. Pat. No. 4,830,378, for a Golf Ball With Uniform Land Configuration, discloses a golf ball with dimples that have triangular shapes. The total land area of Aoyama is no greater than 20% of the surface of the golf ball, and the objective of the patent is to optimize the uniform land configuration and not the dimples.

Another variation in the shape of the dimples is set forth in Steifel, U.S. Pat. No. 5,890,975 for a Golf Ball And Method Of Forming Dimples Thereon. Some of the dimples of Steifel are elongated to have an elliptical cross-section instead of a circular cross-section. The elongated dimples make it possible to increase the surface coverage area. A design patent to Steifel, U.S. Pat. No. 406,623, has all elongated dimples.

A variation on this theme is set forth in Moriyama et al., U.S. Pat. No. 5,722,903, for a Golf Ball, which discloses a golf ball with traditional dimples and oval-shaped dimples.

A further example of a non-traditional golf ball is set forth in Shaw et al., U.S. Pat. No. 4,722,529, for Golf Balls, which discloses a golf ball with dimples and 30 bald patches in the shape of a dumbbell for improvements in aerodynamics.

Another example of a non-traditional golf ball is Cadorniga, U.S. Pat. No. 5,470,076, for a Golf Ball, which discloses each of a plurality of dimples having an additional recess. It is believed that the major and minor recess dimples of Cadorniga create a smaller wake of air during flight of a golf ball.

Oka et al., U.S. Pat. No. 5,143,377, for a Golf Ball, discloses circular and non-circular dimples. The non-circular dimples are square, regular octagonal and regular hexagonal. The non-circular dimples amount to at least forty percent of the 332 dimples on the golf ball. These non-circular dimples of Oka have a double slope that sweeps air away from the periphery in order to make the air turbulent.

Machin, U.S. Pat. No. 5,377,989, for Golf Balls With Isodiametrical Dimples, discloses a golf ball having dimples with an odd number of curved sides and arcuate apices to reduce the drag on the golf ball during flight.

Lavallee et al., U.S. Pat. No. 5,356,150, discloses a golf ball having overlapping elongated dimples to obtain maximum dimple coverage on the surface of the golf ball.

Oka et al., U.S. Pat. No. 5,338,039, discloses a golf ball having at least forty percent of its dimples with a polygonal shape. The shapes of the Oka golf ball are pentagonal, hexagonal and octagonal.

Ogg, U.S. Pat. No. 6,290,615 for a Golf Ball Having A Tubular Lattice Pattern discloses a golf ball with a non-dimple aerodynamic pattern.

The HX® RED golf ball and the HX® BLUE golf ball from Callaway Golf Company of Carlsbad, Calif. are golf balls with non-dimple aerodynamic patterns. The aerodynamic patterns generally consist of a tubular lattice network that defines hexagons and pentagons on the surface of the golf ball. Each hexagon is generally defined by thirteen facets, six of the facets being shared facets and seven of the facets been internal facets.

BRIEF SUMMARY OF THE INVENTION

One aspect of the present invention is a golf ball with a plurality of dimples and a plurality of multi-faceted polygons. The aerodynamic pattern of the present invention allows for high surface coverage of the golf ball with dimples and polygons to provide greater distance when the ball is struck with a golf club by a golfer. The surface coverage is preferably from 70% to 95% of the surface area of the golf ball.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
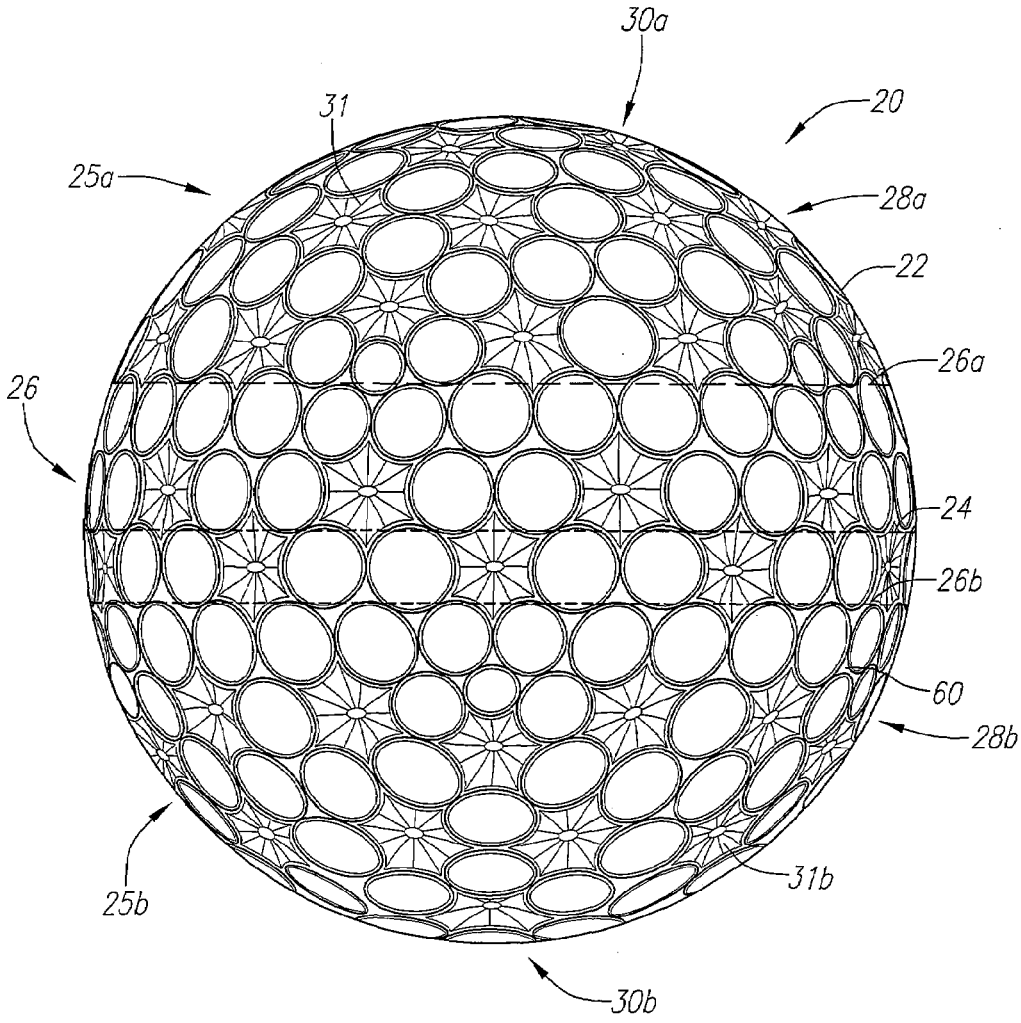
FIG. 1 is an equatorial view of a golf ball of the present invention.
Figure 2:
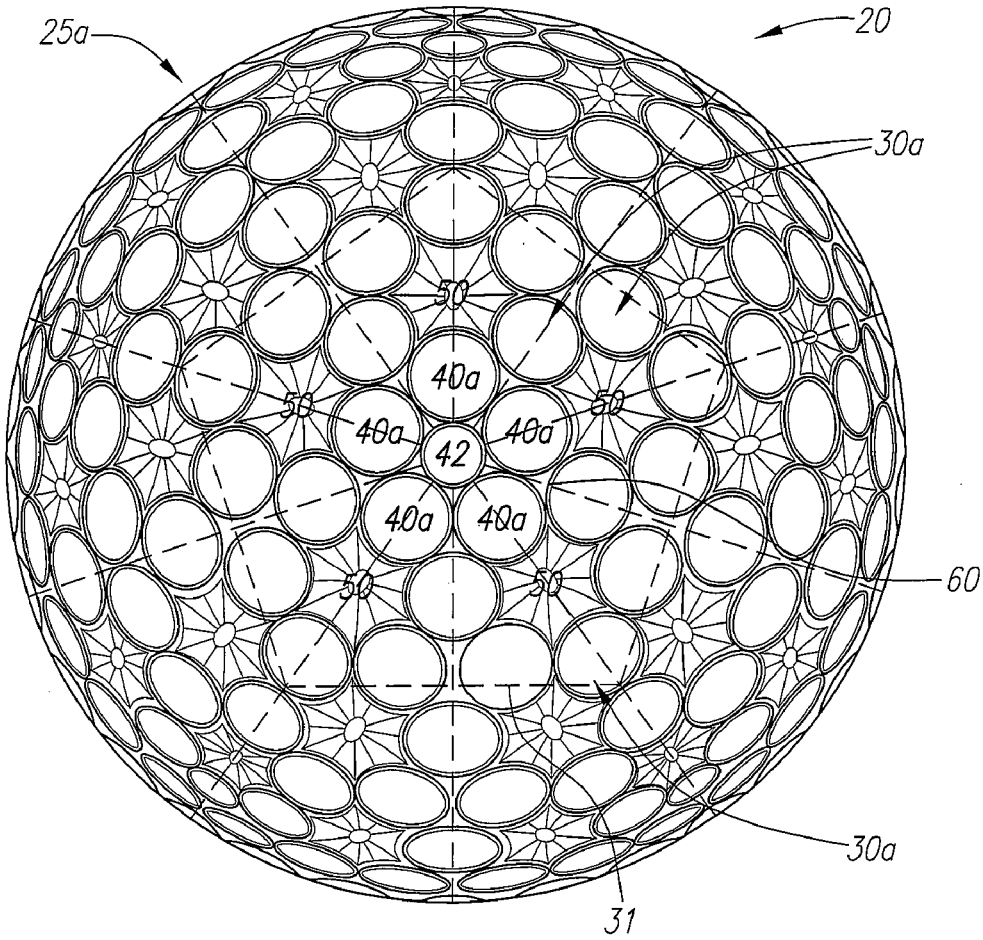
FIG. 2 is a polar view of the golf ball of FIG. 1.

As shown in FIGS. 1-2, a golf ball is generally designated 20. The golf ball 20 may be a two-piece golf ball, a three-piece golf ball, or a greater multi-layer golf ball. The golf ball 20 may be wound or solid. The golf ball 20 is preferably constructed as set forth in U.S. Pat. No. 6,855,073 for a Golf Ball Which Includes Fast Chemical-Reaction—Produced Component And Method Of Making Same, which pertinent parts are hereby incorporated by reference. Alternatively, the golf ball is constructed as set forth in U.S. Pat. No. 6,117,024, for a Golf Ball With A Polyurethane Cover, which pertinent parts are hereby incorporated by reference. Additionally, the core of the golf ball 20 may be solid, hollow, or filled with a fluid, such as a gas or liquid, or have a metal mantle. The cover of the golf ball 20 may be any suitable material. A preferred cover for a three-piece golf ball is composed of a thermoset polyurethane material. Alternatively, the cover may be composed of a thermoplastic polyurethane, ionomer blend, ionomer rubber blend, ionomer and thermoplastic polyurethane blend, or like materials. A preferred cover material for a two-piece golf ball is a blend of ionomers. Those skilled in the pertinent art will recognize that other cover materials may be utilized without departing from the scope and spirit of the present invention. The golf ball 20 may preferably have a finish of one or more basecoats and/or one or more top coats.

The golf ball 20 preferably has a surface 22 that is formed from the cover. The surface 22 has an aerodynamic pattern comprising dimples 40, multi-faceted polygons 50 and land area 60. The golf ball has an equator 24 (shown by dashed line) generally dividing the golf ball 20 into a first hemisphere 25*a* and a second hemisphere 25*b*. A first pole dimple 42 is generally located ninety degrees along a longitudinal arc from the equator 24 in the first hemisphere 25*a*. A second pole 42 is generally located ninety degrees along a longitudinal arc from the equator 24 in the second hemisphere 25*b*.

An equatorial region 26 is generally defined by dashed lines 26*a* and 26*b* which are preferably equidistant from the equator 24. A first polar region 30*a* is defined by line 31 about the first polar dimple 42 and a second polar region 30*b* is defined by line 31*a* about second polar dimple 42. A first latitudinal region 28*a* is generally between line 26*a* and line 31. A second latitudinal region 28*b* is generally between line 26*b* and line 31*a*.

Preferably, the golf ball 20 comprises between 50 to 250 multi-faceted polygons 50 and 200 to 300 dimples 40. More preferably, the golf ball 20 comprises 60 to 100 multi-faceted polygons 50 and 220 to 260 dimples 40.

In a preferred embodiment, the multi-faceted polygons 50 and dimples 40 cover 70% to 90% of the surface area of the surface 22 of the golf ball 20. More preferably, the multi-faceted polygons 50 and dimples 40 cover 78% to 85% of the surface area of the surface 22 of the golf ball 20. In a preferred embodiment, the land area 60 covers 10% to 30% of the surface 22 of the golf ball 20. Most preferably, the land area 60 covers 15% to 22% of the surface 22 of the golf ball 20. Preferably the land area 60 ranges from 1.60 square inches to 2.00 square inches, more preferably from 1.70 square inches to 1.80 square inches, and most preferably 1.784 square inches.

In a preferred embodiment, the golf ball 20 has six sets of dimples 40 that each has a different diameter varying from 0.160 inch to 0.190 inch. The pole dimples 42, which are included in the plurality of dimples 40, preferably has the smallest diameter.

Figure 3:
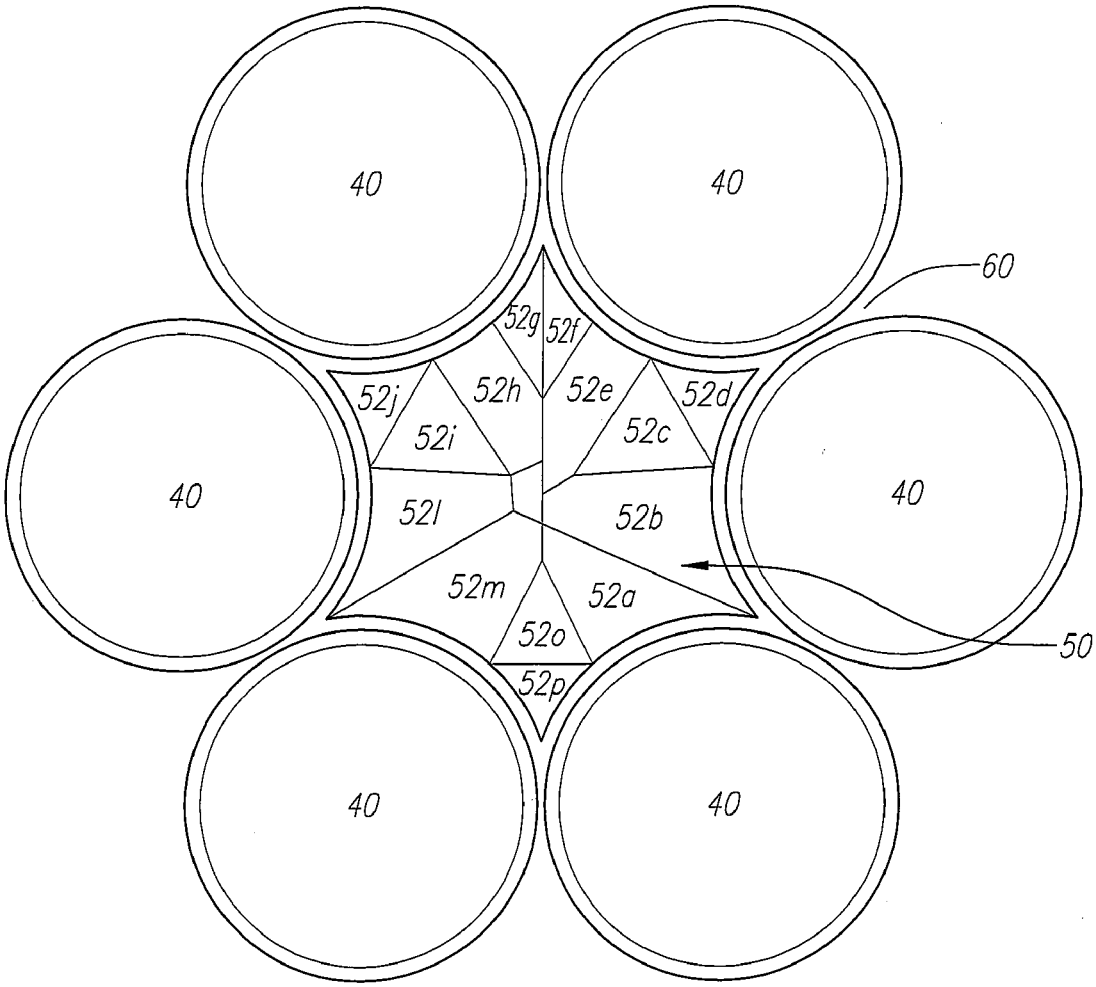
FIG. 3 is an isolated view of a multi-faceted polygon surrounded by dimples.
Figure 4:
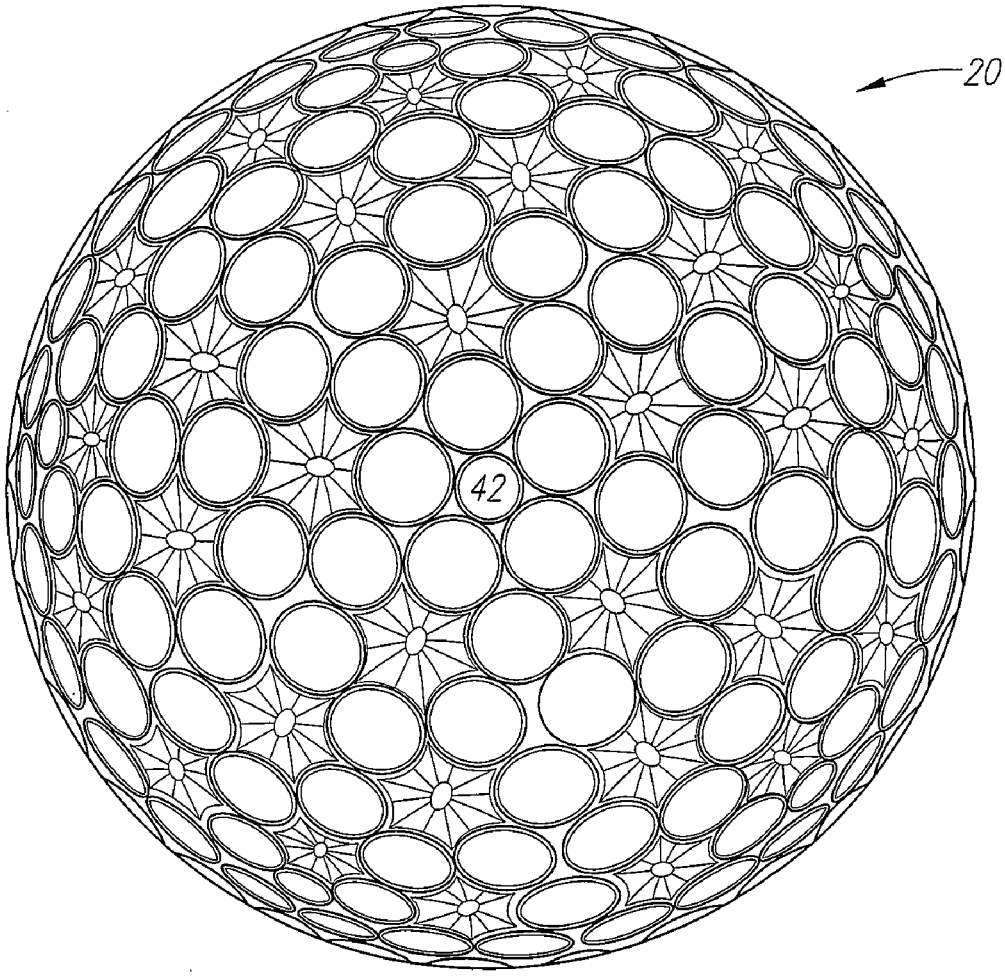
FIG. 4 is a polar view of a golf ball of the present invention.
Figure 5:
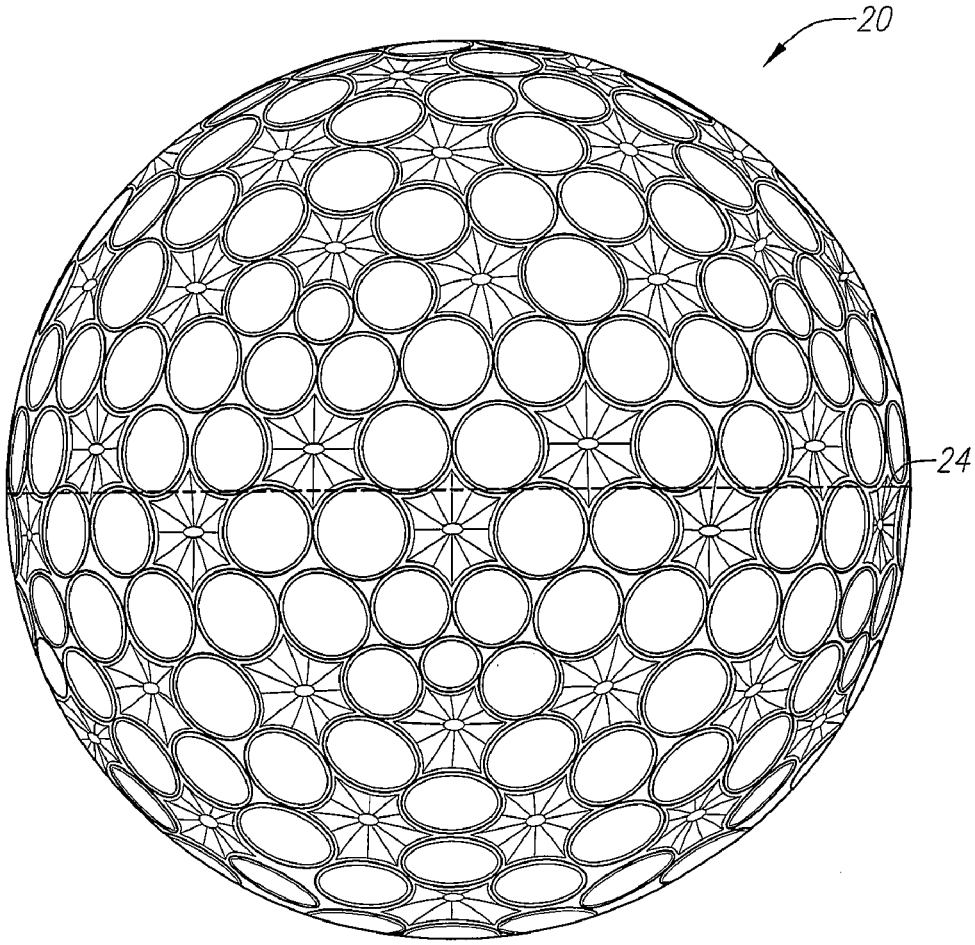
FIG. 5 is an equatorial view of the golf ball of FIG. 4.
Figure 6:
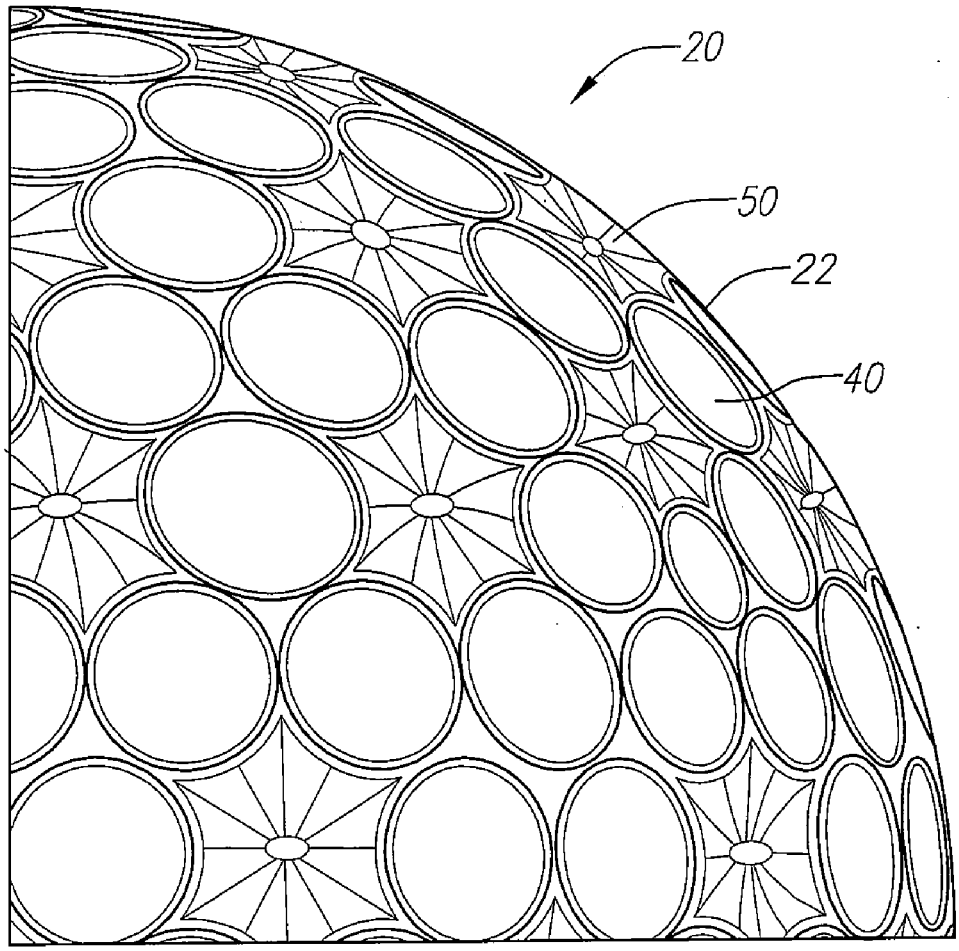
FIG. 6 is an isolated view of a portion of the golf ball of FIG. 4.
Figure 7:
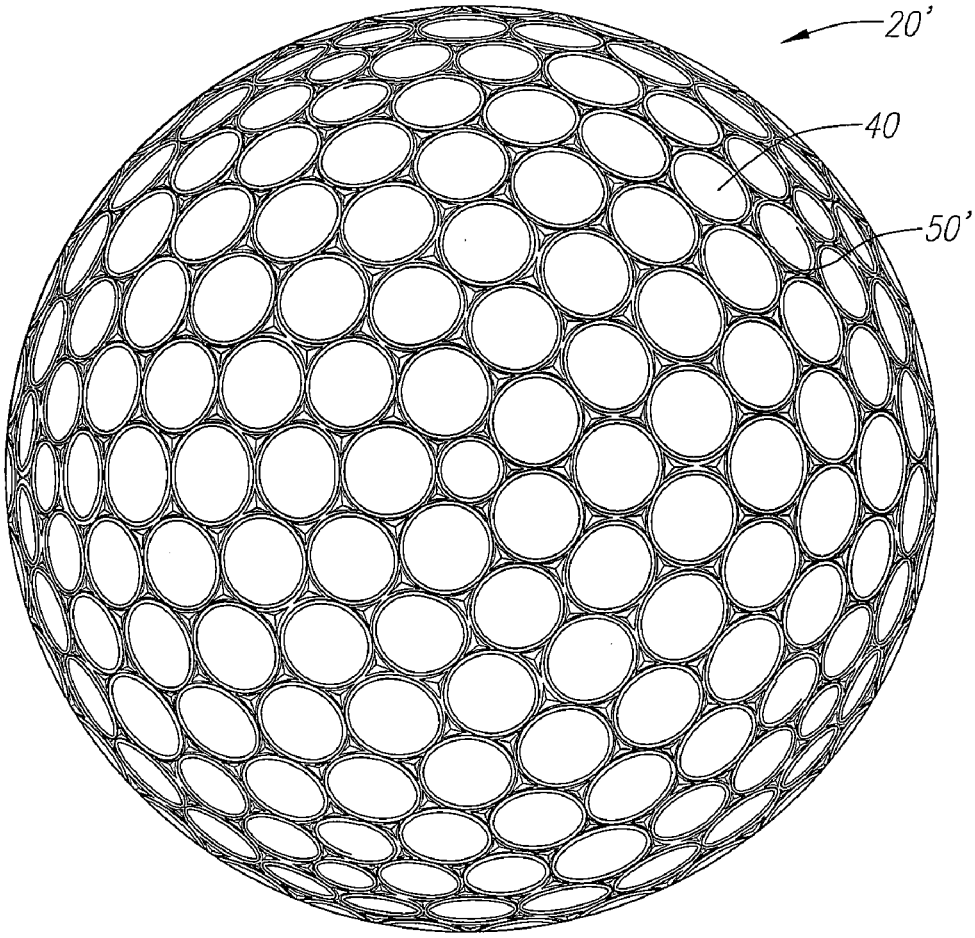
FIG. 7 is an equatorial view of an alternative embodiment of a golf ball of the present invention.

As shown in FIG. 3, each multi-faceted polygon preferably has more than ten facets 52. In a preferred embodiment, each multi-faceted polygon 50 has sixteen facets 52*a*-52*p*. Preferably each multi-faceted polygon 50 is surrounded by six dimples 40.

Preferably, each multi-faceted polygon 50 has a depth ranging from 0.004 inch to 0.01 inch. Preferably, each multi-faceted polygon 50 has an entry angle of approximately 14 degrees and an entry radius of approximately 0.025 inch.

Figure 9:
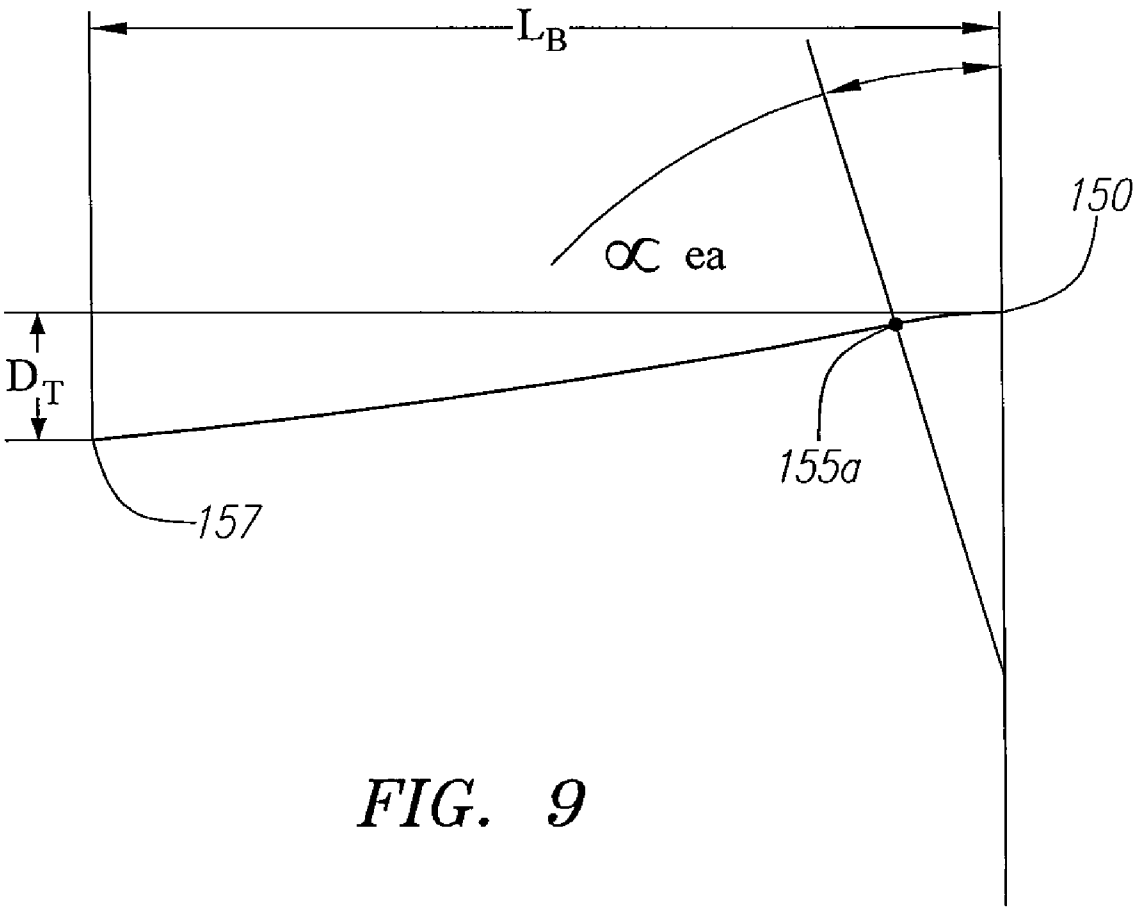
FIG. 9 is an enlarged, isolated, cross-sectional view of a multi-faceted polygon.

As shown in FIG. 9, the depth $D_T$, of each of the plurality of multi-faceted polygon 50 from a bottom of the multi-faceted polygon 50 to an apex 150 of the multi-faceted polygon 50 ranges from 0.004 inch to 0.010 inch, and is most preferably 0.007 inch.

Figure 8:
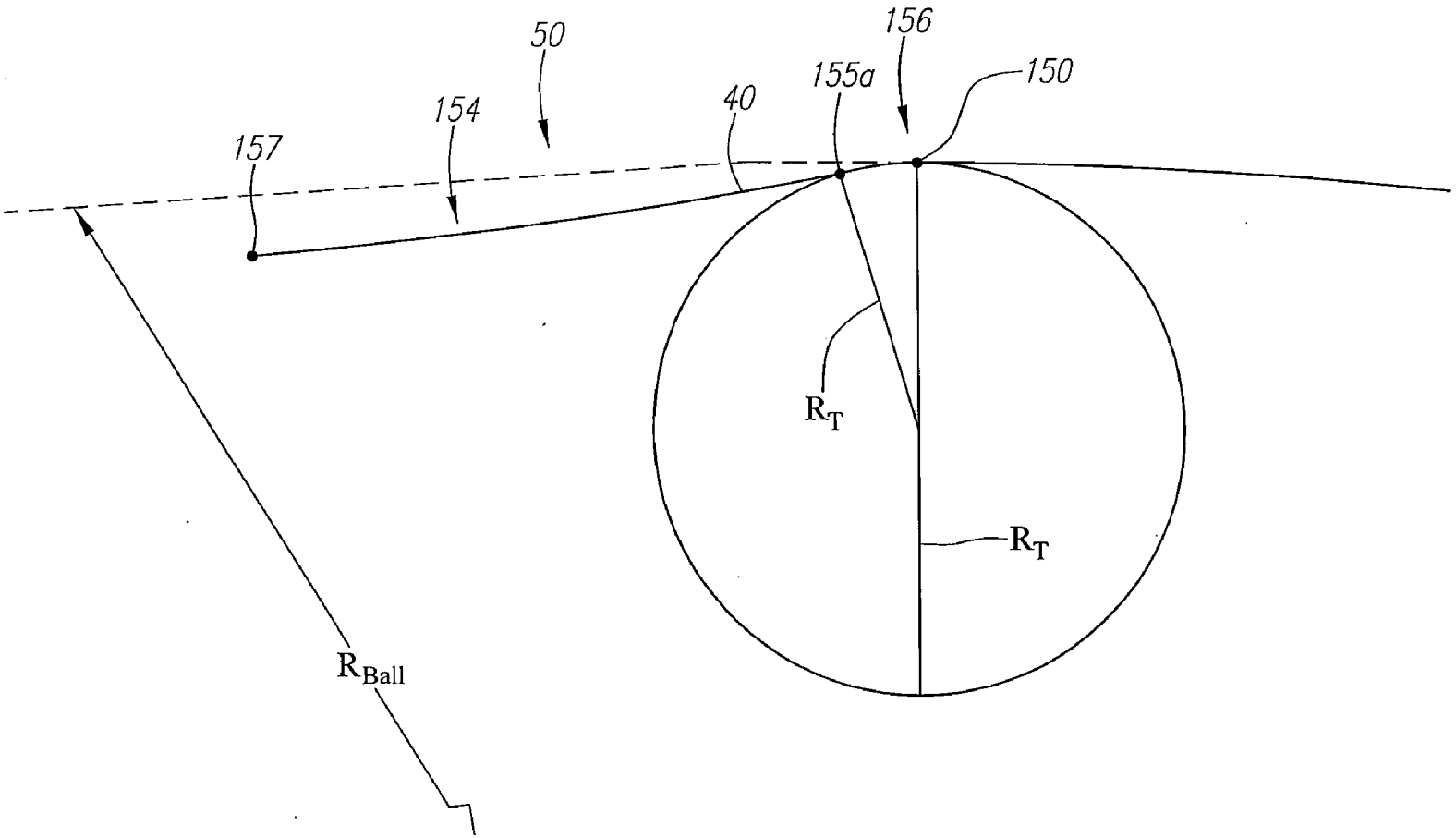
FIG. 8 is an enlarged, isolated, cross-sectional view of a multi-faceted polygon.
Figure 10:
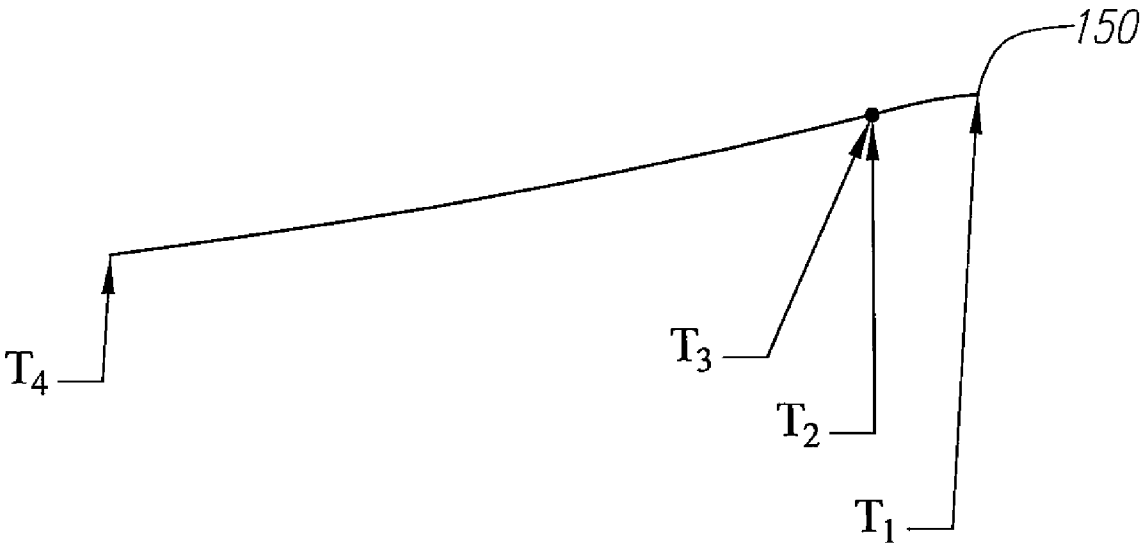
FIG. 10 is an enlarged, isolated, cross-sectional view of a multi-faceted polygon.

As shown in FIGS. 8-10, each multi-faceted polygon 50 is constructed using a radius $R_T$, of an imaginary tube set within the golf ball 20. In a preferred embodiment the radius $R_T$ is approximately 0.048 inch. The apex 150 of the multi-faceted polygon 50 preferably lies on the radius $R_T$, of the imaginary tube. Point 155*a* represents the inflection point of the multi-faceted polygon 50, and inflection point 155*a* preferably lies on the radius $R_T$, of the imaginary tube. At inflection point 155*a*, the surface contour of the multi-faceted polygon 50 preferably changes from concave to convex. Point 157 represents the bottom of multi-faceted polygon 50. The surface contour of the multi-faceted polygon 50 is preferably concave between point 157 and inflection point 155*a* and convex between inflection point 155*a* and apex 150.

As shown in FIG. 9, a blend length $L_B$ is the distance from point 157 to apex 150. An entry angle $\alpha_{EA}$ is the angle relative the tangent line at the inflection point 155*a* and a tangent line through the apex 150. In a preferred embodiment, the entry angle $\alpha_{EA}$ is approximately 14 degrees.

Each multi-faceted polygon 50 preferably has a contour that has a first concave section 154 (between point 157 and inflection point 155*a*) and a convex section 156 (between inflection point 155*a* and apex). In a preferred embodiment, each of the multi-faceted polygon 50 has a continuous contour with a changing radius along the entire surface contour. The radius $R_T$ of each of the multi-faceted polygon 50 is preferably in the range of 0.020 inch to 0.070 inch, more preferably 0.040 inch to 0.050 inch, and most preferably 0.048 inch. The inflection point 155*a*, is preferably defined by the radius $R_T$. The curvature of the convex section 156, however, is not necessarily determined by the radius $R_T$. Instead, one of ordinary skill in the art will appreciate that the convex section 156 may have any suitable curvature.

The continuous surface contour of the golf ball 20 allows for a smooth transition of air during the flight of the golf ball 20. The air pressure acting on the golf ball 20 during its flight is preferably driven by the contour of each dimple 40 and each multi-faceted polygon 50. Reducing the discontinuity of the contour reduces the discontinuity in the air pressure distribution during the flight of the golf ball 20, which reduces the separation of the turbulent boundary layer that is created during the flight of the golf ball 20.

The surface contour each of the multi-faceted polygon 50 is preferably based on a fifth degree Bézier polynomial having the formula:

$$P(t)=3B_iJ_{n,i}(t)\ 0\leqq t\geqq 1$$

wherein P(t) are the parametric defining points for both the convex and concave portions of the cross section of the multi-faceted polygon 50, the Bézier blending function is $$J_{n,i}(t)=\binom{n}{i}t^i(1-t)^{n-i}$$

and n is equal to the degree of the defining Bézier blending function, which for the present invention is preferably five. t is a parametric coordinate normal to the axis of revolution of the dimple. $B_i$ is the value of the ith vertex of defining the polygon, and i=n+1. A more detailed description of the Bézier polynomial utilized in the present invention is set forth in *Mathematical Elements For Computer Graphics*, Second Edition, McGraw-Hill, Inc., David F. Rogers and J. Alan Adams, pages 289-305, which are hereby incorporated by reference.

For the multi-faceted polygon 50, the equations defining the cross-sectional shape require the location of the point 157, the inflection point 155*a* and 55*b*, the apex 150, the entry angle $\alpha_{EA}$, the radius of the golf ball $R_{ball}$, the radius of the imaginary tube $R_T$, the curvature at the apex 150, and the depth, $D_T$.

Additionally, as shown in FIG. 10, tangent magnitude points also define the bridge curves. Tangent magnitude point $T_1$ corresponds to the apex 150 (convex curve), and a preferred tangent magnitude value is 0.5. Tangent magnitude point $T_2$ corresponds to the inflection point 155*a* (convex curve), and a preferred tangent magnitude value is 0.5. Tangent magnitude point $T_3$ corresponds to the inflection point 155*a* (concave curve), and a preferred tangent magnitude value is 1. Tangent magnitude point $T_4$ corresponds to the point 157 (concave curve), and a preferred tangent magnitude value is 1.

This information allows for the surface contour of the multi-faceted polygon 50 to be designed to be continuous throughout the multi-faceted polygon 50. In constructing the contour, two associative bridge curves are prepared as the basis of the contour. A first bridge curve is overlaid from the point 157 to the inflection point 155*a*, which eliminates the step discontinuity in the curvature that results from having true arcs point continuous and tangent. The second bridge curve is overlaid from the inflection point 155*a* to the apex 150. The attachment of the bridge curves at the inflection point 155*a* allows for equivalence of the curvature and controls the surface contour of the multi-faceted polygon 50. The dimensions of the curvature at the apex 150 also controls the surface contour of the lattice member. The shape of the contour may be refined using the parametric stiffness controls available at each of the bridge curves. The controls allow for the fine tuning of the shape of each of the lattice members by scaling tangent and curvature poles on each end of the bridge curves.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf ball comprising:

a plurality of dimples ranging from 220 to 260 dimples; and a plurality of multi-faceted polygons ranging from 60 to 100 multi-faceted polygons, each of the plurality of multi-faceted polygons having at least ten facets, each of the plurality of multi-faceted polygons surrounded by at least six dimples of the plurality of dimples, each of the plurality of multi-faceted polygons having a depth, $D_T$, from the bottom of the multi-faceted polygon to an apex of the multi-faceted polygon ranging from 0.004 inch to 0.01 inch.

2. The golf ball according to claim 1 wherein each of the plurality of multi-faceted polygons is triangular in shape.

3. The golf ball according to claim 1 wherein the plurality of dimples and the plurality of a multi-faceted polygons cover 70% to 90% of a surface area of the golf ball.

4. The golf ball according to claim 3 wherein the golf ball further comprises land area and the land area covers 10% to 30% of the surface area of the golf ball.

5. The golf ball according to claim 1 wherein the plurality of dimples comprises six different sets of dimples, each of the sets of dimples having a different diameter.

6. The golf ball according to claim 5 wherein the six different sets of dimples vary in diameter from 0.160 inch to 0.190 inch.

7. A golf ball comprising:

a core having a diameter ranging from 1.20 inches to 1.64 inches;

a cover having a thickness ranging from 0.015 inch to 0.075 inch, a surface of the cover comprising a plurality of dimples ranging from 220 to 260 dimples and a plurality of multi-faceted polygons, the plurality of multi-faceted polygons ranging from 60 to 100 multi-faceted polygons, each of the plurality of multi-faceted polygons having at least ten facets, each of the plurality of multi-faceted polygons surrounded by at least six dimples of the plurality of dimples, each of the plurality of multi-faceted polygons having a depth, $D_T$, from the bottom of the multi-faceted polygon to an apex of the multi-faceted polygon ranging from 0.004 inch to 0.01 inch;

wherein the golf ball has a diameter ranging from 1.65 inches to 1.72 inches.

8. The golf ball according to claim 7 wherein the core comprises a polybutadiene material.

9. The golf ball according to claim 7 further comprising an inner layer disposed between the core and the cover, the inner layer having a thickness ranging from 0.025 inch to 0.100 inch.

10. The golf ball according to claim 7 wherein the cover is composed of a polyurethane material.

11. The golf ball according to claim 7 wherein the cover is composed of an ionomer material.

12. The golf ball according to claim 7 wherein each of the plurality of multi-faceted polygons is triangular in shape.

13. The golf ball according to claim 7 wherein the number of plurality of dimples ranges from 200 to 300.

14. The golf ball according to claim 7 wherein the plurality of dimples and the plurality of a multi-faceted polygons cover 70% to 90% of a surface area of the golf ball.

15. The golf ball according to claim 14 wherein the golf ball further comprises land area and the land area covers 10% to 30% of the surface area of the golf ball.

* * * * *